United States Patent [19]

Edelman et al.

[11] Patent Number: 4,501,319

[45] Date of Patent: Feb. 26, 1985

[54] PIEZOELECTRIC POLYMER HEAT EXCHANGER

[75] Inventors: Seymour Edelman, Silver Spring, Md.; Lowell D. Ballard, Sterling Park, Va.

[73] Assignee: The United States of America as represented by the Secretary of the Army, Washington, D.C.

[21] Appl. No.: 460,221

[22] Filed: Jan. 24, 1983

Related U.S. Application Data

[63] Continuation of Ser. No. 30,966, Apr. 17, 1979, abandoned.

[51] Int. Cl.[3] ..... F28D 11/06; F28G 7/00

[52] U.S. Cl. ..... 165/84; 310/369; 310/800

[58] Field of Search ..... 165/84; 310/800, 369

[56] References Cited

U.S. PATENT DOCUMENTS

| | | | |
|---|---|---|---|
| 3,814,172 | 6/1974 | Shore | 165/84 X |
| 4,236,235 | 11/1980 | Gilbert | 310/800 X |
| 4,406,323 | 9/1983 | Edelman | 165/84 |
| 4,423,768 | 1/1984 | Edelman et al. | 310/800 X |

*Primary Examiner*—Sheldon J. Richter
*Assistant Examiner*—Randolph A. Smith
*Attorney, Agent, or Firm*—Anthony T. Lane; Jeremiah G. Murray; Robert A. Maikis

[57] ABSTRACT

Disclosed is apparatus for providing for increased heat transfer efficiency of a heat exchanger by separating contiguous fluid conductive channels by means of a flexible sheet fabricated from a piezoelectric polymer. An electrode pattern of predetermined configuration is applied to one or both sides of the piezoelectric sheet and an electrical signal applied thereto in order to set the sheet into a flexual resonance condition whereupon a standing wave pattern is established to not only break up the boundary layer of fluid which adheres to each side of the sheet, but also minimizing the thickness of the laminar sub-layer.

2 Claims, 11 Drawing Figures

FIG. 1
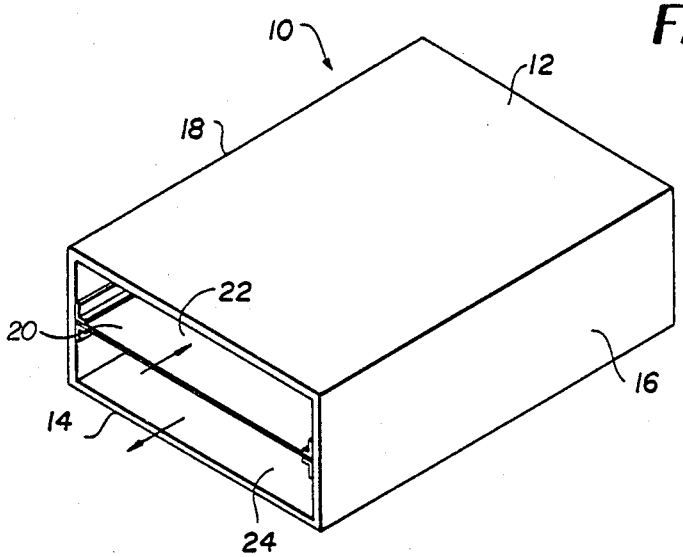
FIG. 2
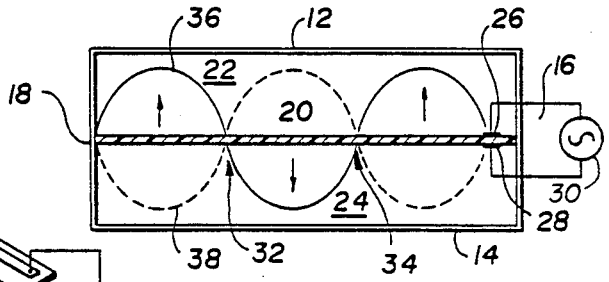
FIG. 3A
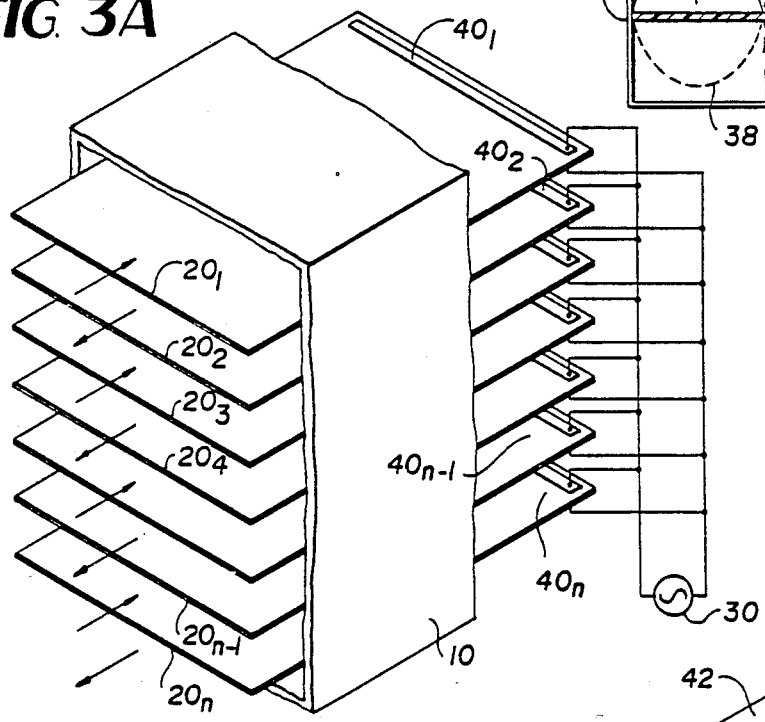
FIG. 6A
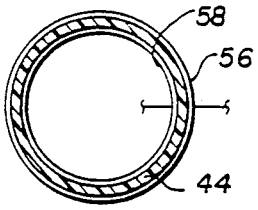
FIG. 6B
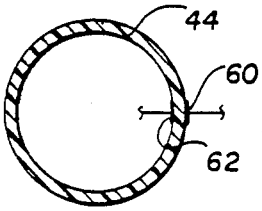
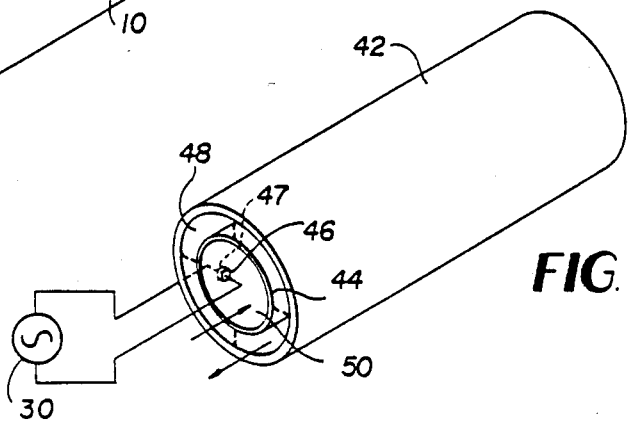
FIG. 4

FIG. 3B
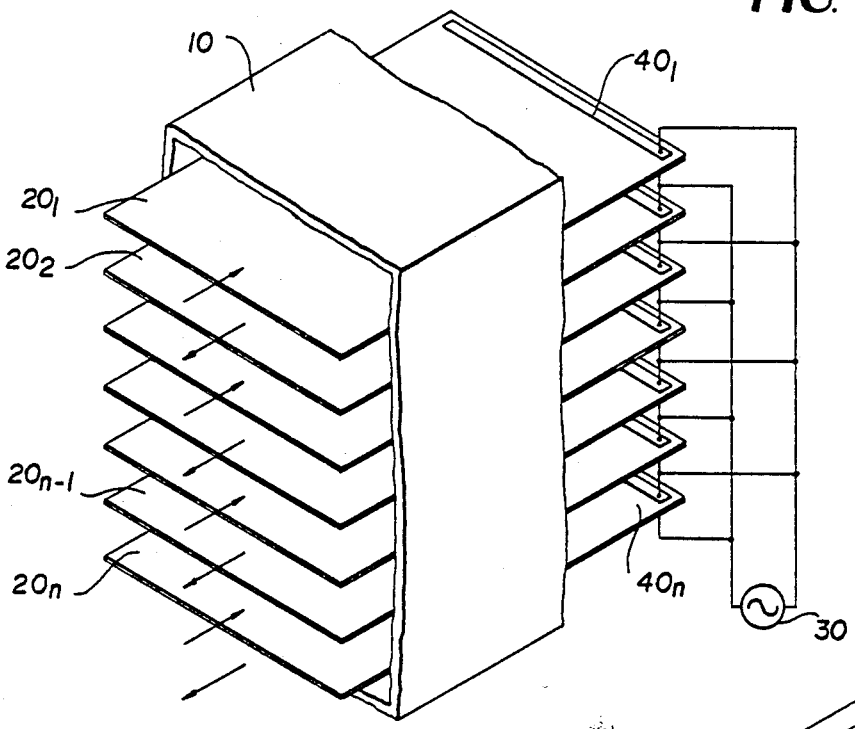
FIG. 5A
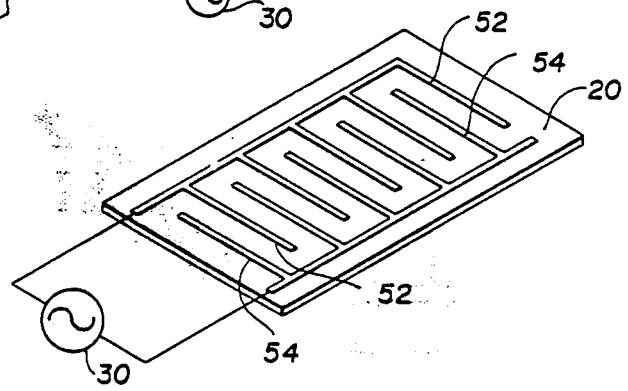
FIG. 5B
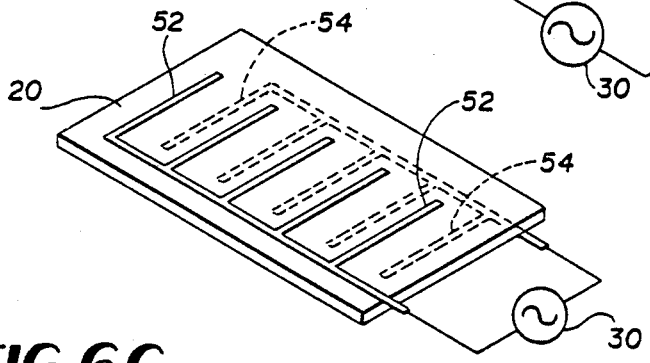
FIG. 6C
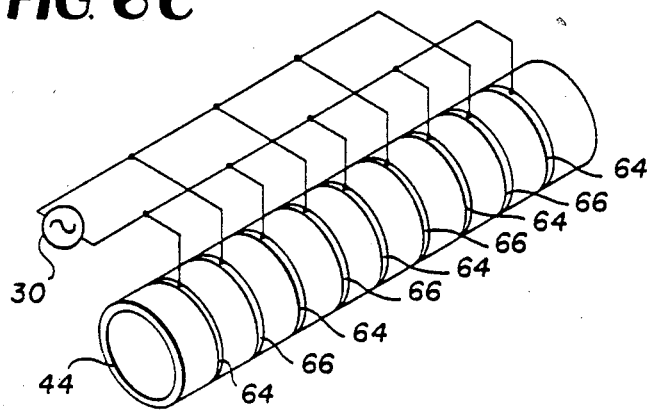
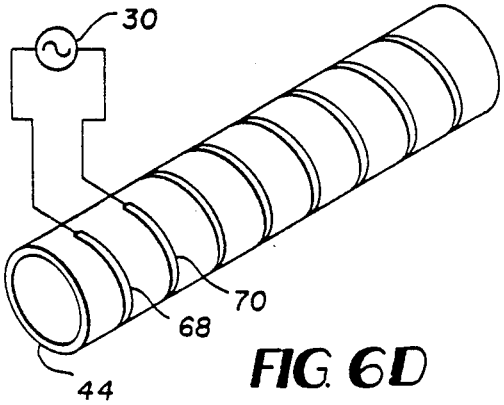
FIG. 6D

PIEZOELECTRIC POLYMER HEAT EXCHANGER

The invention described herein may be manufactured and used by or for the Government for governmental purposes without the payment of any royalties thereon or therefor.

This application is a continuation of application Ser. No. 030,966, filed Apr. 17, 1979, now abandoned.

BACKGROUND OF THE INVENTION

This invention relates generally to apparatus for effecting heat transfer between two fluids separated by a heat conducting barrier and more particularly to a means for increasing the efficiency of the transfer across the barrier.

In the technology relating to heating exchangers, it is well known that the principal impediment to the transfer or transmission of heat from a warm fluid to a cold fluid is the boundary layer of fluid which adheres to each side of the partition or barrier separating the two fluids. Even when the motion of the fluids are fully turbulent, there exists a laminar sub-layer which in conventional heat exchangers does more to obstruct the transmission of heat than the partition itself. While various methods and types of apparatus have been suggested for overcoming the problem such as by means of driving the fluid with sonic waves and vibrating the partition with external vibration generators, these measures while being effective to some extent, are inherently limited in their ability to generate a motion which is particularly adapted to minimize the thickness of the laminar sub-layer on each side of the partition.

SUMMARY

It is an object of the present invention, therefore, to provide apparatus for increasing the efficiency of the transfer in a fluid heat exchanger.

It is yet another object of the present invention to provide an improvement in heat exchange apparatus which is adapted not only to promote mixing between the laminar sub-layer and the turbulent fluid, but also to promote the flow of fluids within the heat exchanger.

These and other objects of the present invention are realized by utilizing a flexible sheet of piezoelectric material as the barrier or partition between at least two alternately hot and cold heat exchanger channels. The flexible piezoelectric partition includes a predetermined pattern of electrodes to which is applied an alternating current electrical signal having a frequency substantially equal to the natural resonance frequency of the partition which when applied causes the sheet to flex at its resonance frequency and in so doing sets up a standing wave or traveling wave pattern. The resulting undulating movement of substantially large areas of the partition is periodic and perpendicular to the plane of the sheet to thereby create a wave or flipping motion which is adapted to push the sub-laminar layer of the fluid adjacent the sheet away into the turbulent stream while drawing other fluid into contact with the partition.

BRIEF DESCRIPTION OF THE DRAWINGS

FIG. 1 is a perspective view broadly illustrative of a first embodiment of the subject invention;

FIG. 2 is a diagram illustrative of the operation of the embodiment shown in FIG. 1;

FIGS. 3A and 3B are generally illustrative of two versions of multi-channel heat exchangers having a plurality of piezoelectric polymer sheets separating alternating hot and cold fluid conductive channels;

FIG. 4 is a perspective view of a tubular type of heat exchanger having an inner channel conductor comprised of piezoelectric polymer sheet material;

FIGS. 5A and 5B are diagrams generally illustrative of two types of inter digited electrode patterns for use on generally flat piezoelectric sheet partitions utilized in heat exchangers of substantially rectangular cross section such as shown in FIGS. 1 and FIGS. 3A and 3B; and FIGS. 6A, 6B, 6C and 6D are illustrative of several forms of electrode patterns utilized in connection with heat exchangers which are generally circular in cross section or at least the inner tube is circular in cross section such as shown in FIG. 4.

DESCRIPTION OF THE PREFERRED EMBODIMENTS

Referring now to the drawings wherein like reference numerals refer to like components throughout, reference is first made to the embodiment shown in FIG. 1 which is intended to illustrate a basic two channel heat exchanger including a housing 10, commonly referred to as a shell, of a generally rectangular transverse cross section. The housing 10, for example, consists of generally flat top and bottom walls 12 and 14 and a pair of substantially flat side walls 16 and 18. The inside of the housing 10 includes a generally flat partition or barrier 20 of uniform thickness and cross section suitably held in place between the side walls 16 and 18 in order to define a pair of contiguous fluid conductive channels 22 and 24, one of which is adapted to translate a warm fluid while the other conducts a cold fluid. As shown in FIG. 1, the fluid flowing in channel 22 is intended to flow in one direction, while the fluid in channel 24 is adapted to flow in the opposite direction. This is merely a matter of choice, since when desirable, both fluids could be made to flow in any direction. What is important, however, is that heat transfer is desired from the warm to cold fluid through the partition 20.

In the subject invention, the partition 20 is comprised of a flexible sheet of piezoelectric polymer material consisting of, for example, polyvinylidene fluoride. The thickness of the piezoelectric sheet 20 as noted above is substantially uniform and is of sufficient dimensions to safely support the stresses to which it is subjected when operating in its intended environment.

Referring now to FIG. 2, the piezoelectric sheet 20 includes in its basic configuration at least one pair of electrodes 26 and 28 formed, for example, on opposite sides of the sheet 20 and are adapted to be coupled to an AC signal source 30. Application of an AC signal to electrodes 26 and 28 of a frequency substantially equal to the natural frequency of the structural configuration of the piezoelectric sheet 20 will cause the sheet to flex and establish a standing wave or traveling wave pattern therein in which the surface area exclusive of the nodal points 32 and 34, for example, periodically move perpendicular and bidirectionally with respect to the plane of the sheet. The natural resonance condition of the piezoelectric sheet 20 can be determined either by well known calculation techniques, or simply by experimentation. Because of the nature of the piezoelectric polymer from which the sheet 20 is formed, the signal applied to the electrodes 26 and 28 causes the thickness and area of the film to alternately decrease and increase, as the electrical signal is varied sinusoidally. The amplitude of the motion of the standing wave pattern will increase with each cycle until the power applied from the signal source equals the electrical power dissipated.

As has been noted the principal impediment to the transmission of heat from the warm fluid channel to the cold fluid channel is the boundary layer of fluid which adheres to each side of the partition.

Even when the motion of the fluid(s) is/are fully turbulent, as in the case of known prior art apparatus, there is still, however, a laminar sub-layer existing on the surface of the partition which does more to obstruct the transmission of heat than the partition itself. The fluidic motion induced by the piezoelectric sheet 20 of the subject invention, however, when energized provides a simple and efficient means to minimize the thickness of the laminar sub-layer and thus increase the heat transfer efficiency of a fluid heat exchanger.

That this occurs can be understood by considering a cycle of periodic motion as evidence by the wave 36 of FIG. 2. As the partition sheet 20 begins to move from its neutral position towards one channel 22, for example, the fluid ahead of it is pushed mid-stream where both the mean motion and the turbulence are greatest providing the greatest tendency to mix the fluid in the laminar layer with the turbulent fluid. Then while the fluid in the laminar layer is still moving towards the center of the channel, the partition sheet 20 reverses its motion and begins to move back towards the neutral position. The inertia of the fluid in the laminar layer will tend to cause separation from the partition and in the ideal case, leaving only those molecules which are in intimate contact with partition 20 to continue to move with it, reducing the thickness of the laminar sub-layer to molecular dimensions. As the partition or sheet 20 passes neutral position moving towards the other channel as evidenced for example by the wave 38, the available volume is greater and fluid from all sides is driven in by the pressure gradient and the diffusion until the motion of the partition stops and reverses, causing more mixing of the boundary layer with turbulent fluid and thus causing intimate contact between the partition and the fluid in a manner heretofore unachievable.

Referring now to the other illustrative embodiments of the invention, reference is now made to FIGS. 3A and 3B. Both of these embodiments include a generally rectangular housing 10 which is adapted to support a plurality of piezoelectric polymer partition sheets $\mathbf{20}_1$, $\mathbf{20}_2$, $\mathbf{20}_3$ . . . $\mathbf{20}_{n-1}$ and $\mathbf{20}_n$. The sheets are arranged in substantially parallel relationship to establish a multichannel heat exchanger having alternately hot and cold channels in stacked relationship. Thus the fluid flow in the respective channels containing alternately hot and cold fluid either in parallel, counterflow or cross-flow directions is effected. The configuration disclosed in FIG. 3A, moreoever, is intended to illustrate the manner in which the AC signal source 30 is coupled to respective electrode pairs located on opposite sides of each of the piezoelectric sheets $\mathbf{20}_1$ . . . $\mathbf{20}_n$. The electrode pattern, moreover, consists of transverse longitudinal strip type electrodes $\mathbf{40}_1$, $\mathbf{40}_2$ . . . $\mathbf{40}_{n-1}$ and $\mathbf{40}_n$. It should be noted that with respect to the configuration of FIG. 3A, the signal source 30 is coupled in parallel to the electrode pairs in the same phase relationship so as to establish a substantially in-phase parallel wave motion of all the piezoelectric partition sheets.

With respect to the embodiment shown in FIG. 3B on the other hand, the electrode pairs $\mathbf{40}_1$ . . . $\mathbf{4}_n$ are coupled to the AC signal source 30 in an alternate phase connection such that the respective electrodes of each piezoelectric sheet with respect to its neighboring sheet are coupled in phase opposition which when energized, will have a tendency for mutually opposing piezoelectric partition sheets to create a substantially opposing or peristaltic type of wave motion, thereby creating a pumping action for the fluid flowing in the respective parallel channels, as well as minimizing the thickness of the laminar sub-layer as previously described.

Referring now to the embodiment of FIG. 4, there is shown a cylindrical or tubular type of heat exchanger wherein a tubular outer shell 42 comprised of a substantially rigid type of fluid conductor has a coextensive concentric inner tubular conductor 44 mounted therein by suitable mechanical means with the inner conductor 44 being constructed of piezoelectric polymer sheet material having an electrode means 46 formed on opposing surfaces thereof for being energized by means of an AC signal source 30, suitably coupled thereto. Such a configuration provides a concentric outer channel 48 and an inner channel 50, which is adapted to transmit parallel, counterflow or cross-flow transmission of hot and cold heat exchanger fluids therein. The application of an AC signal to the electrode means 46 will cause a standing wave or traveling wave pattern to be set up within the cylindrical inner piezoelectric polymer conductor 44 in a manner already described.

Thus what has been shown and described thus far is a heat exchanger consisting of at least one pair of fluid conductive channels separated by a piezoelectric polymer partition which when energized by an electrical AC signal applied thereto causes flexible motions thereof. Where a plurality of parallel channels are involved, the flexual motions from each channel can be coordinated so that the cross section of those portions of a channel where appreciable motion occurs will be compressed and expanded alternately. The consequent adiabatic heating and cooling will have a further beneficial effect in promoting mixing between the laminar sub-layer and the turbulent fluid found primarily at the center of the respective channels. The motion of the partitions, the thinning of the boundary layer and the mixing of the fluid promoted by the embodiments shown in FIGS. 1 through 4 tends to weaken the shear force exerted by the partition on the fluid in the channel, thus reducing viscous drag and improving the flow of fluid in the channel.

The remainder of the figures are intended to illustrate the various other types of electrode patterns which can be formed on both flat and tubular piezoelectric polymer partitions to create the desired flexual motions. FIG. 5A, for example, discloses a flat piezoelectric partition member 20, on which a plurality of inter digited electrodes 52 and 54 are formed on the same surface. The set of parallely oriented electrodes 52 are commonly connected to one side of the AC signal source 30 while the other set of parallely oriented electrodes 54 are commonly connected to the other side of the AC signal source. A modification of the electrode configuration shown in FIG. 5A is disclosed in FIG. 5B, whereupon the first set of finger type electrodes 52 are formed on one side of the piezoelectric sheet 20, while the second set of finger type electrodes 54 are formed on the opposite side of the piezoelectric sheet. In both cases like electrodes 52 and 54 are connected in parallel across the signal source 30. When desirable, however, the source connections to the individual electrodes can be of any electrical connection.

Referring now to FIGS. 6A through 6D, there is disclosed several contemplated variations of electrode patterns utilized in connection with cylindrical or tubular type of piezoelectric polymer partitions such as the flexible inner member 44 of piezoelectric material shown in FIG. 4. The cross sectional configuration of FIG. 6A is intended to illustrate an electrode configuration consisting of inner and outer electrodes 56 and 58 which completely encircle the respective inner and outer surfaces of the piezoelectric tubular member 44. The concentric circular electrodes 56 and 58 can easily be arranged in a coplanar arrangement or can be offset with respect to one another. In the configuration shown in FIG. 6B, the electrodes 60 and 62 comprise circular segments of electrode material only partially encircling the piezoelectric tubular partition 44. In the configurations in FIGS. 6A and 6B, one electrode is formed on the inner surface of the tubular member 44, while the other electrode is formed on the outer surface.

With respect to the embodiments of FIGS. 6C and 6D, however, the respective electrode patterns are formed only on the outer surface of the piezoelectric tubular partition member 44. In the arrangement shown in FIG. 6C, a first set of circular electrodes 64 are connected in parallel to one side of the AC source 30, while a second intervening set of electrodes 66 is coupled in parallel to the opposite side of the source 30. In all cases, alternating electrodes 64 and 66 are regularly spaced along a predetermined portion of the tubular partition's length. The configuration of FIG. 6D comprises a double helix electrode configuration formed on the outer surface of the tubular member 44 and consisting of two lengths of electrode material 68 and 70 wound in a screw thread fashion along the tube's length and being coupled at their mutually same ends to the signal source 30.

Having thus shown and described what is at present considered to be the preferred embodiments of the present invention, modifications thereto will readily occur to those skilled in the art. It is not desired, therefore, that the invention be limited to the specific arrangements shown and described, but it is intended to cover all such modifications and alterations which fall into the spirit and scope of the invention as defined in the appended claims.

What we claim is:

1. A heat exchanger having a plurality of fluid conductive channels for relatively warm and cold fluids respectively separated by a plurality of heat conductive partitions, each of said channel partitions consisting of flexible piezoelectric polymer material; and means connected to each of said partitions applying an alternating current of a predetermined frequency thereto to cause said piezoelectric polymer material to achieve a flexual resonance condition and thereby generate a wave pattern in said partitions to cause a substantial portion of the surface of said partitions to periodically undulate, said last-named means including a signal source and electrode means formed on each partition coupled to said signal source, said electrode means consisting of at least first and second electrodes, first circuit means commonly coupling one side of said signal source to a predetermined number of said first electrodes, and second circuit means commonly coupling the opposite side of said signal source to a predetermined number of said second electrodes.

2. A heat exchanger having a plurality of fluid conductive channels for relatively warm and cold fluids respectively separated by a plurality of heat conductive partitions, each of said channel partitions consisting of flexible piezoelectric polymer material; and means connected to each of said partitions applying an alternating current of a predetermined frequency thereto to cause said piezoelectric polymer material to achieve a flexual resonance condition and thereby generate a wave pattern in said partitions to cause a substantial portion of the surface of said partitions to periodically undulate, said last-named means including a signal source and electrode means formed on each partition coupled to said signal source, said electrode means consisting of at least first and second electrodes, first circuit means commonly coupling one side of said signal source to first alternate first and second electrodes, and second circuit means commonly coupling the opposite side of said signal source to second alternate first and second electrodes.

* * * * *